US007665888B2

(12) United States Patent
Weinstein et al.

(10) Patent No.: US 7,665,888 B2
(45) Date of Patent: Feb. 23, 2010

(54) TABLETOP DEVICE WITH TWO-SIDED INSTRUCTIONAL DISPLAY

(76) Inventors: Marc Chase Weinstein, 740 Bryant Ave., Roslyn Harbor, NY (US) 11576; Alfredo Cinco, 170L. Gruet Street, San Juan, Metro Manila (PH) 1500

( * ) Notice: Subject to any disclaimer, the term of this patent is extended or adjusted under 35 U.S.C. 154(b) by 207 days.

(21) Appl. No.: 11/742,075

(22) Filed: Apr. 30, 2007

(65) Prior Publication Data

US 2007/0279849 A1 Dec. 6, 2007

Related U.S. Application Data

(60) Provisional application No. 60/795,792, filed on Apr. 29, 2006.

(51) Int. Cl.
*G04B 37/00* (2006.01)

(52) U.S. Cl. ..... 368/276; 40/493

(58) Field of Classification Search ..... 368/276; 40/493, 495, 124.15, 152.1, 120; 248/454
See application file for complete search history.

(56) References Cited

U.S. PATENT DOCUMENTS 3,220,132 A * 11/1965 Swiger et al. ..... 40/711
4,280,291 A * 7/1981 Maynes ..... 40/495
4,467,540 A 8/1984 Gfesser
5,455,808 A 10/1995 Grupp
5,878,003 A 3/1999 Gantet
6,595,683 B1 7/2003 Cetera
7,050,357 B1 * 5/2006 Garcia ..... 368/21
7,117,619 B1 * 10/2006 Huber ..... 40/495
2003/0076745 A1 4/2003 Chapman
2004/0244245 A1 * 12/2004 Abdelrahman ..... 40/495

OTHER PUBLICATIONS http://www.structuralgraphics.com/website/gallery/index.php?strWebAction=project_detail&intProjectID=107 Publication date unknown.

* cited by examiner

*Primary Examiner*—Edwin A. Leon
(74) *Attorney, Agent, or Firm*—Collard & Roe, P.C.

(57) ABSTRACT

The present invention relates to a method and apparatus for providing a tabletop device which provides multiple functions to a user of the device, and in particular, to a tabletop device which includes a first functional element which establishes a preferred orientation on the tabletop for a first user of the device, and which includes a second functional element which is independent of the first functional element, and provides for simultaneous display of correlated information to both the first user of the device and a second user of the device.

13 Claims, 5 Drawing Sheets

TABLETOP DEVICE WITH TWO-SIDED INSTRUCTIONAL DISPLAY

CROSS-REFERENCE TO RELATED APPLICATIONS

This application claims priority under 35 USC 120 of U.S. Provisional Patent Application No. 60/795,792 filed Apr. 29, 2006, entitled "Desk Clock With Inner Turning Detail Wheel" The entire disclosure of the aforementioned provisional application is incorporated herein by reference in its entirety.

TECHNICAL FIELD OF THE INVENTION

The present invention relates to a method and apparatus for providing a tabletop device which provides multiple functions to a user of the device, and in particular, to a tabletop device which includes a first functional element which establishes a preferred orientation on the tabletop for a first user of the device, and which includes a second functional element which is independent of the first functional element, and provides for simultaneous display of correlated information to both the first user of the device and a second user of the device.

SUMMARY OF THE INVENTION

A tabletop device adapted to be supported on the top of a table for providing a combination of functions for a user of the tabletop, said tabletop device comprising:

a base component adapted to be supported on a tabletop, said base component having a front facing side and a rearward facing side, so that when positioned on said tabletop one of the front and rearward facing sides is oriented so as to face a first user of said tabletop device;

a first functional element coupled with said base component, which first functional element provides a first function to the first user of the tabletop device, thereby establishing a preferred orientation on said tabletop of the tabletop device, so that a preferred one of the front and rearward facing sides of the tabletop device is typically oriented so as to face the first user of said tabletop device;

a second functional element coupled with said base component, which second functional element provides a second function to the first user of the tabletop device, which second function is independently operable with respect to the first function, and which second functional element provides a third function to a second user of the tabletop device, where the operation of the third function is correlated with the operation of the second function, and where a side of the tabletop device which is opposite said preferred side is oriented so as to face said second user, thereby providing direct access by said second user to said third function of the tabletop device.

In accordance with one embodiment of the invention, the second functional element is a two-side informational display, where one side provides said second function and an opposite side provides said third function.

In accordance with another embodiment of the invention, the tabletop device includes a base component adapted to be supported on a tabletop, said base component having a front facing side and a rearward facing side, so that when positioned on said tabletop one of the front and rearward facing sides is oriented so as to face a first user of said tabletop device;

a first functional element coupled with said base component, which first functional element:

provides a first function to said first user of the tabletop device, thereby establishing a preferred orientation on said tabletop for the tabletop device, so that a preferred one of the front and rearward facing sides of the tabletop device is typically oriented so as to face the first user of said tabletop device, and provides a second function to a second user of the tabletop device who is positioned at a side of the tabletop device which is opposite said preferred side, and where the operation of said second function is correlated with the operation of said first function.

BRIEF DESCRIPTIONS OF THE DRAWINGS

The accompanying drawings, which are incorporated herein and constitute part of this specification, illustrate embodiments and details of the invention and, together with the general description given above and the detailed description given below, serve to explain various embodiments and aspects of the invention. These drawings are exemplary and may not be to scale, and like reference numerals represent like elements throughout the several views, The above-noted and other advantages of the invention will become apparent upon reading the following detailed description and upon referring to the drawings in which:

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention.

DETAILED DESCRIPTION OF THE PREFERRED EMBODIMENTS

Figure 1:
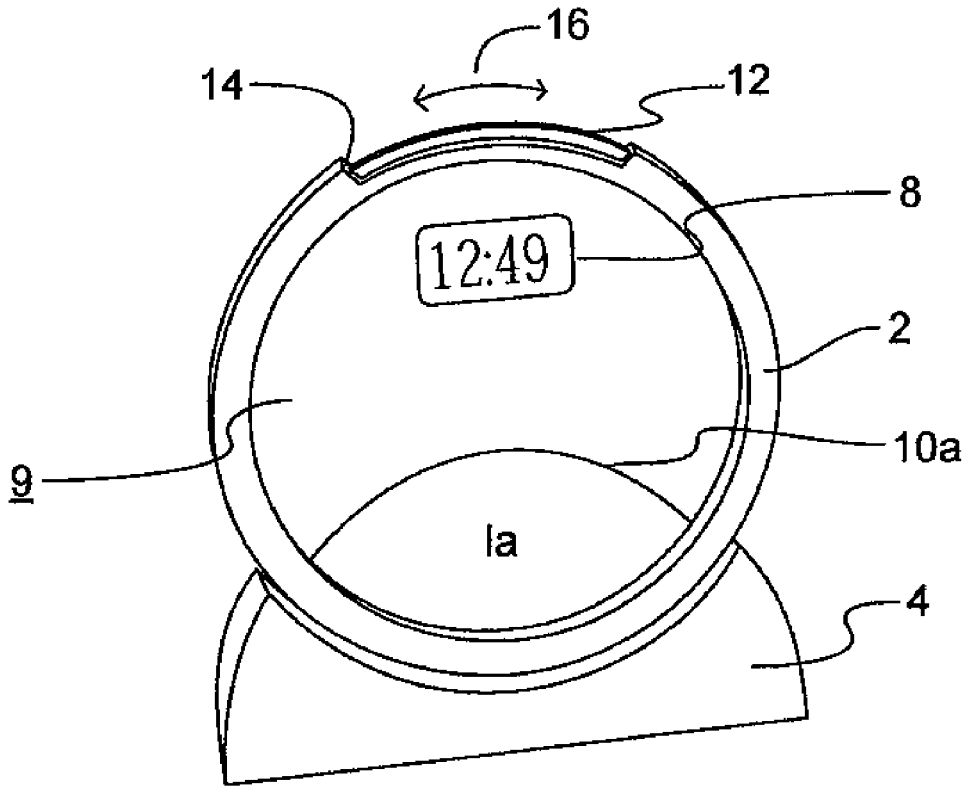
FIGS. 1 and 2 illustrate front and rear perspective views, respectively, of an embodiment of the present invention configured as a tabletop patient information display with a clock.
Figure 2:
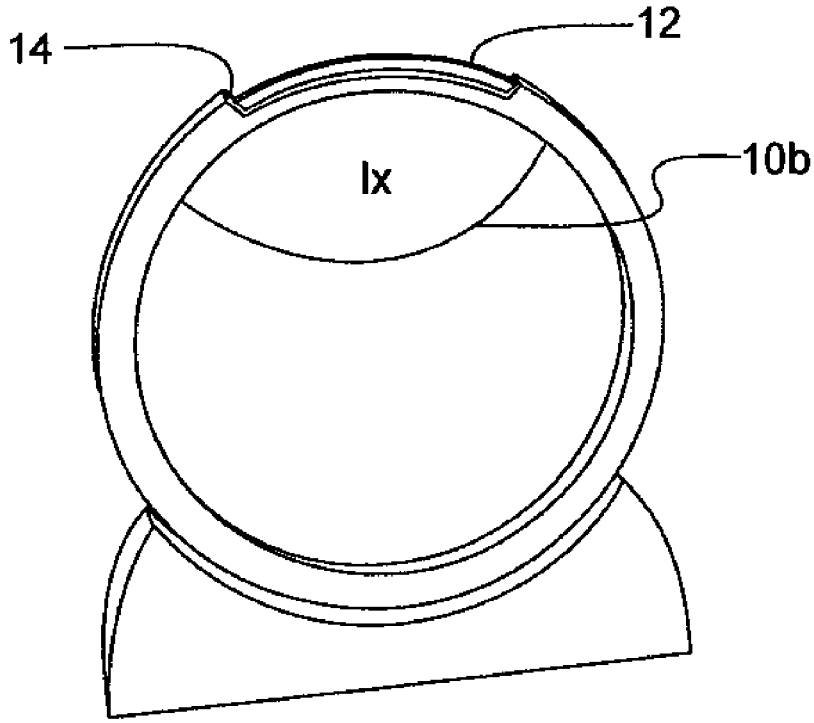
Figure 3:
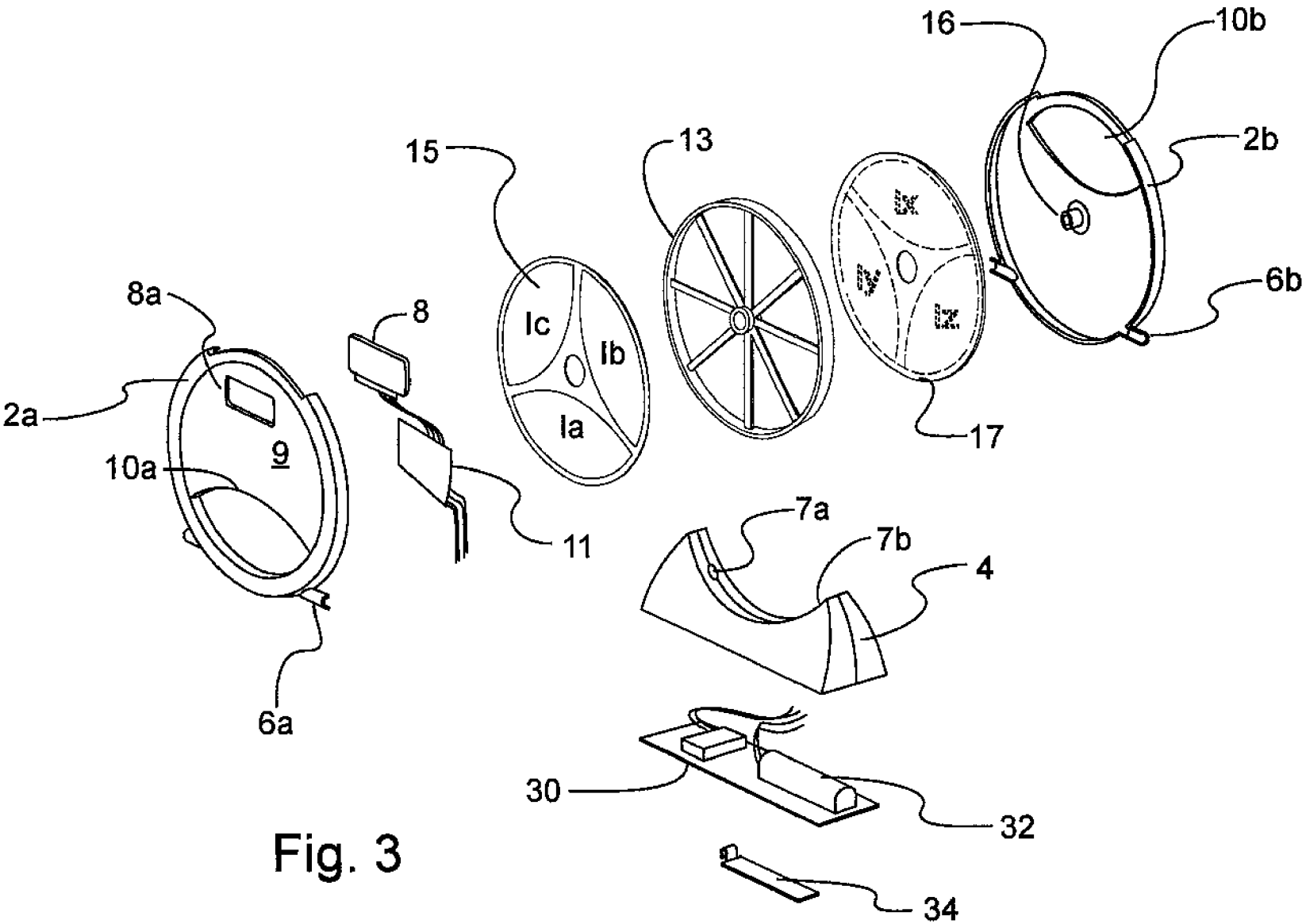
FIG. 3 illustrates an exploded view of the tabletop patient information display clock of FIGS. 1 and 2.

FIGS. 1, 2 and 3 illustrate a patient information tabletop clock embodiment of the present invention, where FIGS. 1 and 2 illustrate front and rear perspective views of a "physician desk clock" embodiment of the invention, and FIG. 3 illustrates an exploded view of the tabletop patient information display with clock of FIGS. 1 and 2. As used herein, the word "tabletop" means any supporting surface at which two people can position themselves in a substantially opposed manner, such as at a desk, a table, a counter, etc.

Referring simultaneously to FIGS. 1, 2 and 3, the physician desk clock embodiment of the invention includes a frame 2 attached to a base 4, the frame having a front face 9 for displaying a clock 8 and information or images I printed on an inner rotatable detail wheel 12. The information or images Ia-c and Ix-z are selectively positionable by rotation of the detail wheel 12, so as to provide for simultaneous viewing of the information or images on the wheel in front and rearward facing windows 10*a* and 10*b*, respectively, of the device, as explained in more detail below.

In this embodiment, a digital desk clock 8 is positioned on the frame 2, and the frame is connected to the base 4 by a hinge 6 (hidden from view in FIGS. 1 and 2, but visible in FIG. 3). The hinge 6 shown will allow a user of the desk clock to tilt the frame 2 so as to adjust the viewing angle to avoid glare and for overall easier viewing of information or images which are selectively positionable for simultaneous viewing in the front and rearward facing windows 10*a* and 10*b* of the device. Although a axle-type hinge 6 is shown, in an alternative embodiment, a different type of hinge could be used, such as a ball and socket, or in fact, a hinge may not be used and the frame 2 can be fixedly attached to the base 4.

Figure 6A:
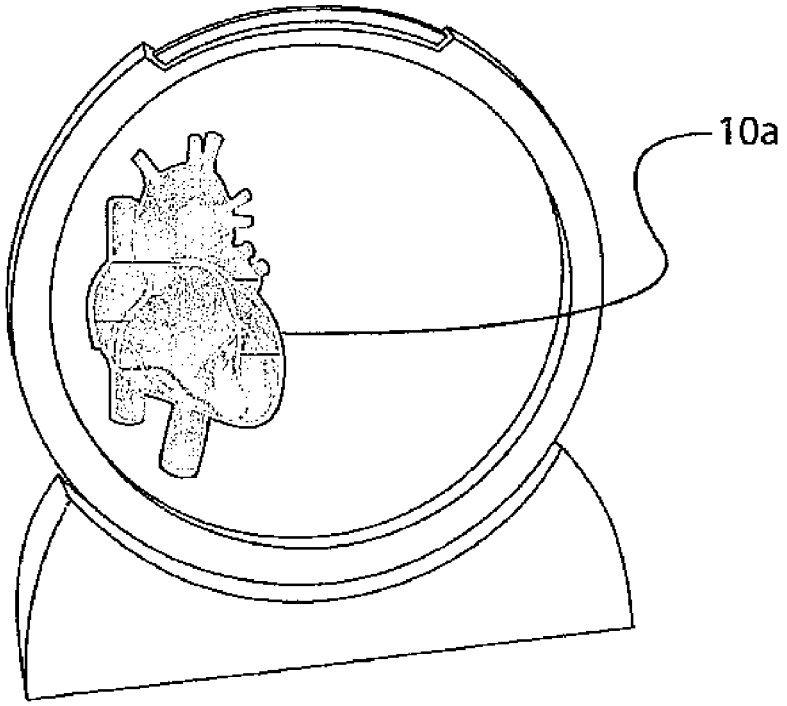
FIGS. 6A and 6B illustrate the front and rearward facing sides of a further alternative embodiment of the invention configured as only a tabletop patient information display.
Figure 6B:
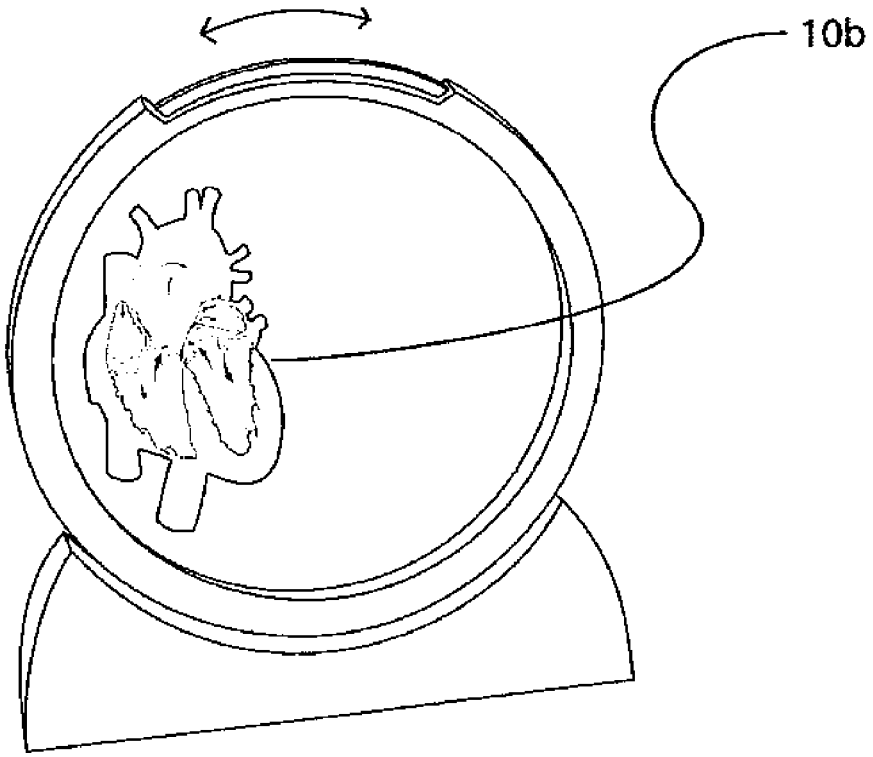

The clock's face or display 8 is mounted to the face 9 of the frame 2 so as to align with an opening 8*a* (shown in FIG. 3) in face 9 so as to allow the clock 8 to be viewable from the front. In this embodiment, digital clock adjustment buttons 30 and a battery compartment 32 having a cover 34 are located in the base. Alternatively, an analog clock could be used. A specific information or image display, such as indicated by Ia-Ic can be selected and viewed through a window 10*a* in the front face 9, which in this example is on the bottom of face 9, although the exact position of window 10*a* on face 9 can vary. A corresponding or related set of information, i.e., as indicated by a corresponding Ix-Iz indication, is simultaneously viewable through a second window 10*b* (as shown in FIG. 3) at rear facing side of frame 2*b*, which in this example is similar to window 10*a*, but is located at the top portion of the rear facing side of frame 2*b*, and could be made larger and possibly have more detailed information or images or some other way of presenting information or images correlated with the information 1*a*-1*c*. Additionally, the shape of the windows 10*a* and/or 10*b* could be different, such as shown in FIGS. 6A and 6B, to be described later.

The information or images are printed on both sides of a printed wheel 12 which is rotatably mounted within frame 2. As shown in the exploded view of FIG. 3, the printed wheel 12 may comprise a central disc-shaped rotatable member 13 having adhered to opposite sides thereof discs 15 and 17 (having a size and shape similar to the size and shape of member 13) of plastic or paper having information or images Ia-Ic and Ix-Iz, respectively, printed or otherwise displayed thereon. Print wheel 12 is held in place in a cavity formed between frame portions 2*a* and 2*b*, by a center post 16 which spans the cavity between frame halves 2*a* and 2*b* and passes through a hole in the center of member 13 and discs 15 and 17, as shown in FIG. 3. Although in this illustrated embodiment, print wheel 12 is manufactured using three components, in an alternative embodiment, it can be formed from a single plastic disc or other substrate material, which has direct printing on both sides thereof, thereby eliminating the requirement for separate pieces discs 15 and 17, and the labor involved in their assembly. Furthermore, the frame portions 2*a* and 2*b* can be permanently bonded together for enclosing wheel 13 therein, or frame portions 2*a* and 2*b* can be designed so as to be separable by the user so as to allow the user to insert a selected one of a plurality of interchangeable wheels therein, each wheel having different information for display thereon.

Due to an opening 14 at a top portion of frame 2 which exposes an outer edge portion of printed wheel 12, wheel 12 is manually rotatable in either or both clockwise and counterclockwise directions, as by indicted by arrow 16.

In another contemplated embodiment the device could have multiple inner turning wheels as compared with the single wheel (13, 15, 17). By creating an open window area in a portion of each of the multiple wheels, all housed within frame 2, the alternative embodiment would allow for a much greater number of different corresponding images to appear to the first and second users. Each wheel would have the same window opening in the same location so that when all are aligned there would be an open window through the device. When the first user turns the desired wheel the corresponding image/information would be visible to both users.

It is noted that hinge 6 is formed by curved extensions 6*a* and 6*b* formed at the bottom sides of frame portions 2*a* and 2*b*, respectively, as shown in FIG. 3. Base 4 includes holes 7*a*, and 7*b* (not visible in FIG. 3) on opposite sides thereof, which serve to hingedly mount frame 2 to base 4. The wires from the power wires from battery 32 and clock adjustment buttons 30, extend through base 4, out holes 7*a*, through hinge 6, to a clock circuit board 11.

In an alternative embodiment, all of the electronics could be in the base 4, or in the frame 2, for example, the clock and all its supporting electronics may be coupled with the base so as to entirely reside in the base or entirely reside in the frame 2 which is couple with the base. Stated in an even more general manner, the functional element, such as the clock, can be coupled with the base so as to reside entirely in the base, entirely in the frame or be as shown in the above described Figures, partially in the base and partially in the frame.

One particular use of this device is as a desk clock for a doctor, where the front and rearward facing windows may selectively display one of multiple choices of correlated information that the doctor can selectively position to be aligned with the windows 10*a* and 10*b* for simultaneous viewing by both of the patient and the doctor, so that during doctor-patient consultations, the doctor can look at his/her side of the desk clock while selecting and viewing a selected one or more of the informations, while the patient can easily see the correlated information as it is presented at the rearward facing side of the informational desk clock, and all the while, the doctor can also see his clock.

As described above, it is noted that the clock portion of the device establishes a preferred orientation of the device on the doctors desk, so that the doctor can easily see the clock while he is working at his desk. Thus, the clock is a first function that the device provides to a user of the device, in this case the doctor. Additionally, the device provides a second functional element for the doctor, and that is the ability to provide an educational display which provides a second function to the doctor and a third function to a second user of the device, in this case, a patient. More specifically, in an example where the educational display relates to high cholesterol, the doctor may see in his display scientific info regarding expected changes in HDL levels based on diet changes HDL levels, and the patient may see a description of diet and lifestyle changes in order to achieve the changed HDL levels that the doctor sees in his display.

Also, the information display can comprise a display of words or images, and the windows 10 can be as shown in FIGS. 1-3, or have some other particular shape, such as the heart shape shown in the embodiment of FIG. 6, where a patient image of the heart would show the affects of various heart diseases, clogged arteries or treatments, and the doctor may see a related image of the heart and/or a technical description of the disease or details of treatments using specific drugs or surgery.

While the invention has been described in the preferred embodiment, many variations are contemplated. For example, the hinge may not be used, the clock may be analog or have a different shape, and the windows can have a different shape, such as round, oval or rectangular. Furthermore, there can be multiple windows, for example, instead of one front and one rearward facing window, there can be two such windows, for simultaneously displaying two informations to the front and back of the device. In such an embodiment, as well known to those of ordinary skill in this technology, the windows would have to be separated by a certain distance, so as to account for space used by the various different ones of the selectable informations that are printed on the wheel for being positioned in the corresponding windows.

Figure 4:
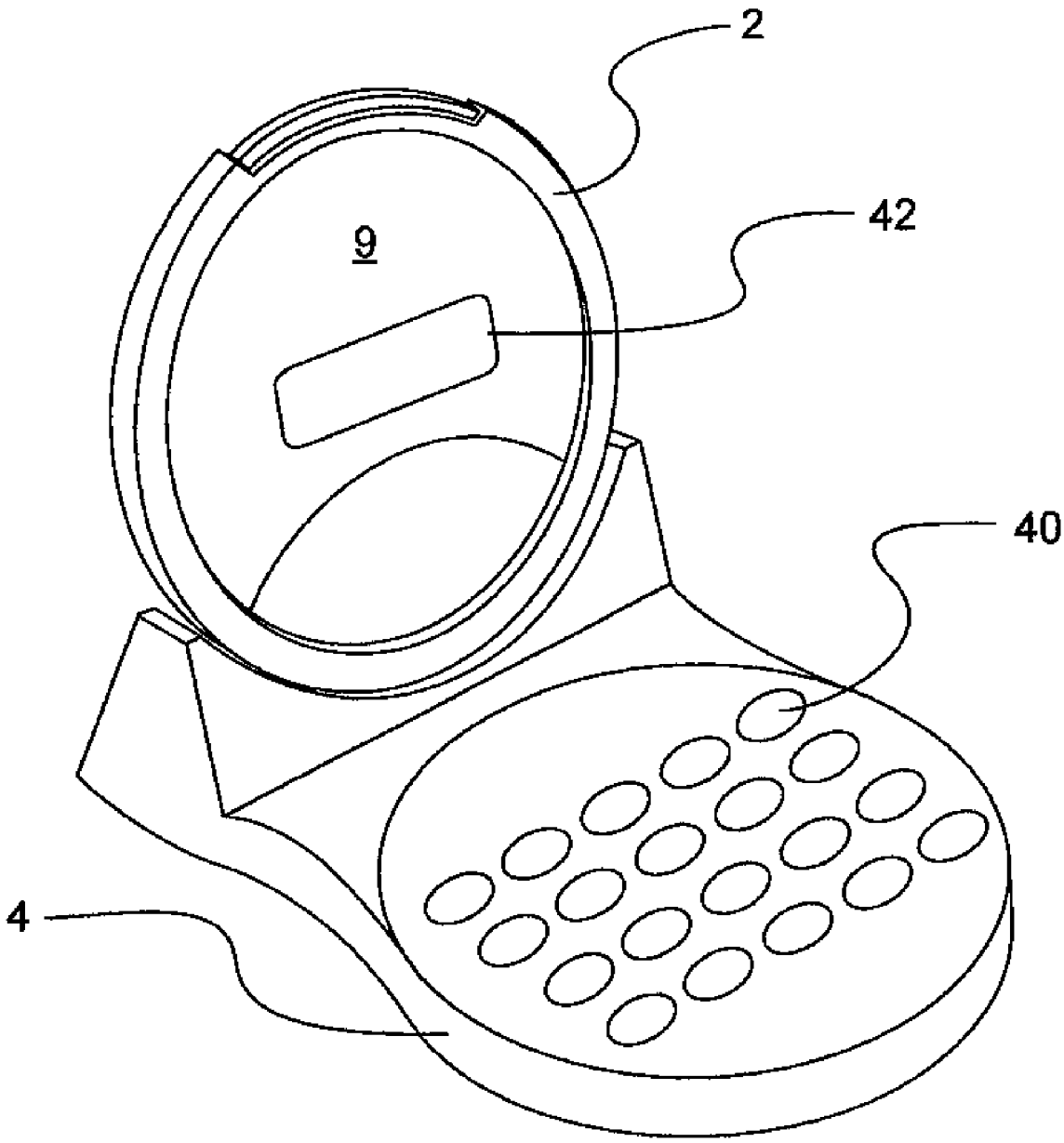
FIG. 4 illustrates an alternative embodiment of the invention configured as a tabletop patient information display with calculator.

Thus, in another of the invention, FIG. 4 illustrates the invention configured so as to provide the tabletop patient information display function, in combination with a calculator function. In this embodiment, the information display is basically the same as shown and described in FIGS. 1-3, however there is no clock display. Instead, the base 4 is extended so as to provide therein a calculator (not shown), however, the keys 40 of the calculator are shown, as well as the display 42. Display 42 is positioned on face 9 in a manner substantially similar to the positioning of clock 8 as shown in FIGS. 1-3. Alternatively, all the electronics could be in the base 4, or in the frame 2, in an embodiment where the calculator and all of its supporting electronics is coupled with the base so as to entirely reside in the base or in the frame 2.

Thus, in another embodiment of the invention, the first functional element may even be non-electronic, and include an element such as a thermometer.

Figure 5:
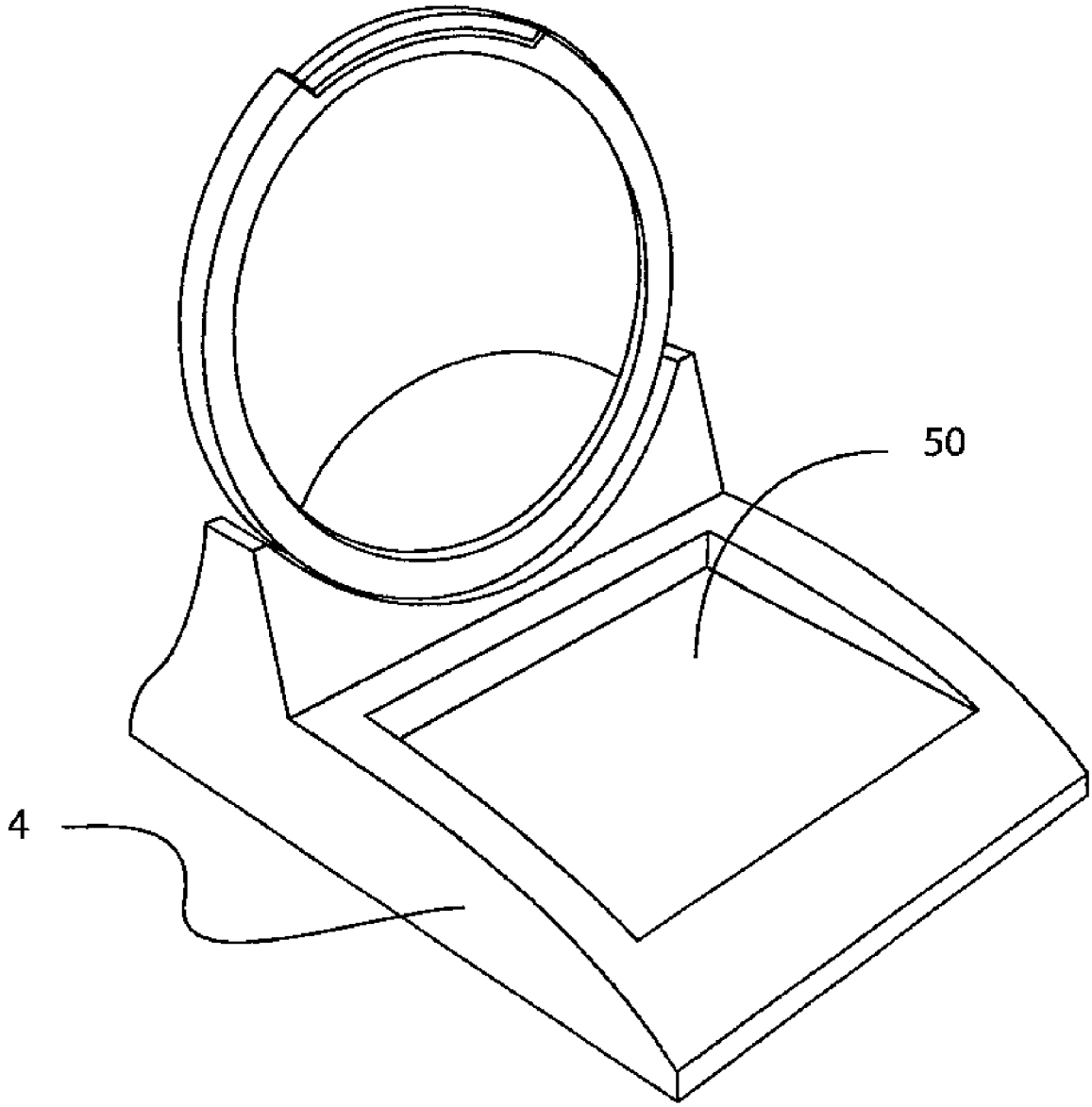
FIG. 5 illustrates an alternative embodiment of the invention configured as a tabletop patient information display with a storage area for holding a note pad or business cards.

Thus, in another embodiment of the invention, FIG. 5 illustrates the invention configured so as to provide the tabletop information display function (to a patient or other "user"), in combination with a storage area function. In this embodiment, the information display is basically the same as shown and described in FIGS. 1-3, however there is no clock display. Instead, the base 4 is extended so as to provide therein a storage area 50 in which a note pad, or business cards or other items can be placed which are useful to a user of the device. For example, if "post-it" type note pads are positioned in area 50, then a preferred orientation for the device would be to face the Doctor or other primary user of the desk or table upon which the device is being supported. However, if the area 50 is used to hold business cards, then the preferred orientation of the device would be to face customers or patients, thereby establishing which users would normally be facing the front and rearwardly facing sides of the device.

In another embodiment of the invention, FIGS. 6A and 6B illustrate the front and rearward facing sides of a tabletop device which provides the information display aspect of the prior embodiments without combination with any other function. However, as previously noted, the windows 10*a* and 10*b* in this embodiment, have a specific shape related to the information displayed. More specifically, window 10*a* may have the shape of and display the exterior of a heart and window 10*b* may display the interior of a heart. Alternatively, window 10*a* may display to the doctor text which describes a heart condition, and window 10 *b* may display to the patient a heart having the condition as described in the text that is displayed to the doctor in window 10*a*.

It is noted that in addition to the calculator and clock embodiments of the invention, other electronic functional elements are anticipated, as well as other non-electronic elements, such as the described calendar or thermometer.

While this invention has been particularly shown and described with references to preferred embodiments thereof, it will be understood by those skilled in the art that various changes in form and details may be made therein without departing from the sphere and scope of the invention. In fact, many such changes are already noted in this description but it should be realized that the above-noted changes were not exhaustive, and merely exemplary. Those skilled in the art will recognize, or be able to ascertain using no more than routine experimentation, many equivalents to the specific embodiments of the invention described herein.

Thus, there has been provided in accordance several aspects of the invention, a method and apparatus to provide a table top device which fully satisfies the objects, aims and advantages set forth above. While the invention has been described in conjunction with specific embodiments thereof, it is evident that many further alternative, modifications and variations will be apparent to those skilled in the art in light of the foregoing description. Accordingly, it is intended to embrace all such alternatives, modifications and variations as falling within the spirit and broad scope of the invention.

The invention claimed is:

1. A tabletop device adapted to be supported on a tabletop for providing a combination of functions for a user of the tabletop device, said tabletop device comprising:

a base component adapted to be supported on a tabletop, said base component having a front facing side and a rearward facing side, so that when positioned on said tabletop one of the front and rearward facing sides is oriented so as to face a first user of said tabletop device;

a first functional element coupled with said base component, which first functional element provides a first function to the first user of the tabletop device, thereby establishing a preferred orientation on said tabletop of the tabletop device, so that a preferred one of the front and rearward facing sides of the tabletop device is typically oriented so as to face the first user of said tabletop device;

a second functional element coupled with said base component, which second functional element provides a second function to the first user of the tabletop device, which second function is independently operable with respect to the first function, and which second functional element provides a third function to a second user of the tabletop device, where the operation of the third function is correlated with the operation of the second function, and where a side of the tabletop device, which is opposite said preferred one of the front and rearward facing sides, is oriented so as to face said second user, thereby providing direct access by said second user to said third function of the tabletop device, wherein the second functional element is a two-sided informational display, where one side provides said second function and an opposite side provides said third function.

2. The device of claim 1, where the first functional element is a clock device coupled with the base so as to: provide a time display function to a user of the tabletop device.

3. The device of claim 1, where the first functional element is a calculator device coupled with the base so as to provide a calculator display and keyboard functions to a user of the tabletop device.

4. The device of claim 1, where the first functional element is a calendar device coupled with the base so as to provide a calendar display function to a user of the tabletop device.

5. The device of claim 1, wherein the two-sided informational display includes:

for providing as said second function, a first information window for directing display of a first information to the first user; and for providing as said third function, a second information window on an opposite side of the two-sided informational display for the simultaneous display of second information to a second user of the tabletop device, where there is a correlation between the first and the second informations displayed.

6. The device of claim 5, wherein the second functional element includes means which allows a user of the tabletop device to selectively change the information displayed in the first and second information windows.

7. The device of claim 6, where the two-sided informational display includes means which allows a user of the tabletop device to selectively change the information displayed in the first and second information windows.

8. The device of claim 7, where said two-sided informational display includes:

a disc-shaped information display, having information displayed on front and rearward facing sides thereof;

a shell device having front and rearward facing sides which are substantially opaque and which form a cavity inside the shell device, which sides also include substantially transparent window portions positioned therein; and means for rotatably mounting said disc-shaped information display in the cavity of said shell device in a manner so that said transparent window portions in the front and rearward facing sides of the shell device simultaneous display correlated information from the front and rearward facing sides, respectively, of the disc-shaped information display.

9. The device of claim 8, where said disc-shaped information display includes separate areas on the front and rearward facing sides thereof, which separate areas have a shape which substantially corresponds with the shape of the transparent windows in the front and rearward facing sides of the shell device, so that when information displayed in one of the areas on a front facing side of the disc-shaped information display is aligned with a front facing window of the shell device, an area on the rearward facing side of the disc-shaped information display has a correlated display of information which is aligned with the rearward facing window of the shell device.

10. The device of claim 8, where the means which allows a user to selectively change the information displayed, comprises an opening in said shell device which is of sufficient size so as to allow one of the first and second users to rotate said disc-shaped information display within said shell device, so as to align a given information on said disc-shaped information display with a substantially transparent window portion of said shell device.

11. The device of claim 1, where the first functional element is a storage compartment coupled with the base so as to provide a storage function to a user of the table.

12. The device of claim 11, where the storage compartment comprises a business card holder.

13. The device of claim 11, where the storage compartment comprises a notepad holder.

* * * * *